United States Patent [19]

Fowler

[11] 4,204,475

[45] May 27, 1980

[54] ARMING-SAFING SYSTEM FOR AIRBORNE WEAPONS

[75] Inventor: Ronald J. Fowler, Columbus, Ohio

[73] Assignee: The United States of America as represented by the Secretary of the Navy, Washington, D.C.

[21] Appl. No.: 823,243

[22] Filed: Apr. 29, 1969

[51] Int. Cl.[2] ..... F42C 15/12; F42C 15/40; F42C 13/04; F42C 11/04

[52] U.S. Cl. ..... 102/262; 89/1.5 D; 102/221

[58] Field of Search ..... 102/70.2, 221, 262; 250/83.3, 199; 89/1.5 D

[56] References Cited

U.S. PATENT DOCUMENTS

| | | | |
|---|---|---|---|
| 3,123,714 | 3/1964 | Chope | 343/100 ST |
| 3,228,337 | 1/1966 | Grantham et al. | 102/207 |
| 3,363,100 | 1/1968 | Cohen et al. | 250/367 |

*Primary Examiner*—S. C. Buczinski

*Attorney, Agent, or Firm*—R. S. Sciascia; Sol Sheinbein

[57] ABSTRACT

The system of the present invention basically consists of a detector unit mounted in each bomb or airborne weapon and operable upon interception of a signal emitted by an aircraft-mounted source. The required signal for arming is present only in a well defined zone below the aircraft and only in response to pilot command during weapon release. The signal consists of mechanically modulated beam of high-energy photons (gamma rays) emitted by a radioisotope source on the aircraft. The weapon must fall well below the aircraft to see the signal. Geiger-Mueller tubes are used for radiation detectors and the resulting signal is processed to initiate the arming or fuzing sequence. Power for the operation of the detector and associated electronics is transferred through the metallic covering of the weapon by means of a split-core transformer at the time of release. The power transferred is capable of operating the unit for the length of time it would normally take the weapon to fall through the signal zone; after which the weapon returns to a dormant, safe, state if no arming signal has been received.

6 Claims, 3 Drawing Figures

ARMING-SAFING SYSTEM FOR AIRBORNE WEAPONS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to arming-safing systems for airborne weapons, and more particularly to systems for arming or safing air dropped weapons a predetermined distance below the aircraft.

The arming of air launched weapons upon release from an aircraft has been the subject of considerable research in recent years. Devices employed by the various systems have the common objective of arming the weapon only after a safe intentional separation of the weapon and aircraft has occurred. Lanyards or arming wires attached to the aircraft and designed to be pulled free of the weapon upon separation to initiate an arming sequence were quite satisfactory for relatively low speed aircraft. The development, however, of jet aircraft capable of operating at near sonic and supersonic speeds complicated the problem. Not only were lanyards or arming wires subject to excessive stresses in flight, but subsequent to weapon launch, the lanyards or arming wires buffeted and frequently damaged the aircraft.

Electrical arming systems appeared to be an answer to the problem, but the manifold increase in numbers and power of radio and radar equipment, especially aboard aircraft carriers, caused these systems to be hazardous to explosive ordnance. These hazards were present even with mechanical lanyards or arming wires, as electromagnetic energy could gain access to explosives through electrical cabling used for control or selection, or through any openings in the weapon casing. A system was needed that could operate through a completely sealed and electrically shielded case, providing means for the selection of weapon options in addition to providing for arming of the weapon. Such a system would provide inherent immunity to the serious hazards of electromagnetic radiation to ordance.

In addition to being free of external mechanical or electromechanical connections and providing complete electrical shielding, a satisfactory remote arming system should have other desirable characteristics. The sealed-in components should be capable of long term inert storage, be ready for use with a minimum of preparation, and require no time-consuming or possibly hazardous loading or checkout procedure on the aircraft.

SUMMARY OF THE INVENTION

The present invention obviates the aforementioned shortcomings of the prior art by providing a system capable of arming air dropped weapons remote from the aircraft without the need for either mechanical or electrical connections between aircraft and weapon at the time of arming. This is accomplished by providing the aircraft with a source of modulated gamma radiation, such as that disclosed in applicant's copending application, Ser. No. 800,837, filed Feb. 18, 1969, now U.S. Pat. No. 3833815; and by providing the weapon with a radiation detector together with circuitry for initiating the arming or fuzing sequence upon detection of the modulated gamma radiation signal. The circuitry is such that unmodulated background radiation, of either high or low intensity, will not initiate the arming sequence.

The present invention possesses numerous other advantages not found in the prior art. It requires absolutely no wires, mechanical attachments, or mechanical openings in the weapon shell, thereby eliminating the problems associated with external cables and wires at supersonic or near-supersonic aircraft speeds. The complete mechanical integrity of the weapon skin without electrical connectors provides inherent immunity to the hazards of high power electromagnetic radiation. The arming device is normally inert and contains no source of energy prior to weapon lunch. At the instant of launch, the power supply is energized for a brief period of time, after which the energy is totally dissipated so that none is left to actuate the arming device; therefore the weapon again becomes dormant and cannot receive an arming signal. This short life cycle provides an inherent safety factor under almost all conceivable accident situations. The unit is small in size and can be readily adapted to most conventional weapons almost without modification. The weapon-borne portion of the system can be made to fit into the existing connector hole in the weapon with the detector placed external to the existing weapon shell. This type of installation allows for easy retrofit to existing weapons and permits the system to be easily used during any transition period from a mechanical to a nucleonic arming system. Present electromechanical systems require cable and connector rigging which consumes a considerable amount of time for the loading and checking of the stores. This procedure adds to the turn-around time of the aircraft and therefore limits aircraft mission time. For the system of the present invention there are absolutely no mechanical or electrical attachments, adjustments, or alignments to be made. If the weapon is attached to the bomb rack hooks, it is ready to operate. Since there is no energy in the arming circuit, the weapon is dormant and completely safe and can be rapidly installed by untrained personnel without hazard.

OBJECTS OF THE INVENTION

It is a primary object of this invention to provide a new and improved arming-safing system for airborne weapons.

It is another object of this invention to provide an arming-safing system for airborne weapons which require no mechanical or electrical connections between aircraft and weapon.

It is a further object of this invention to provide an arming-safing system for airborne weapons in which the arming device is normally inert and contains no source of energy prior to launch.

It is yet another object of this invention to provide an arming-safing system of such design that mechanical integrity of the weapon skin may be maintained.

It is still further object of this invention to provide an arming-safing system for airborne weapons in which the period during which arming can take place is of very short duration immediately subsequent to launch.

BRIEF DESCRIPTION OF THE DRAWINGS

Other objects, advantages and novel features of the invention will become readily apparent upon consideration of the following detailed description when read in conjunction with the accompanying drawings wherein.

DESCRIPTION OF THE PREFERRED EMBODIMENT

Figure 1:
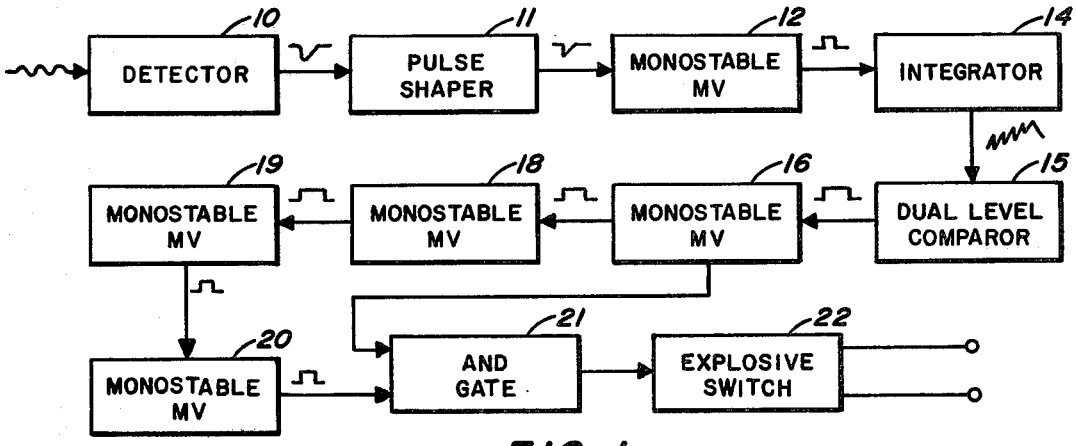
FIG. 1 is a block diagram of the arming-safing system of the present invention.

Referring now to FIG. 1, it can be seen that the system of this invention comprises a detector 10, such as a Geiger-Mueller tube, the output of which is fed to a pulse shaper 11 and then to a monostable multivibrator 12. The output of the multivibrator 12 is applied to an integrator 14 and from here to a dual level comparor 15, such as a schmitt trigger. The comparor output is applied to a monostable multivibrator 16. Output signals from the multivibrator 16 are split with one part of the signal passing through a series of monostable multivibrators 18, 19 and 20 to one input of an AND gate 21 and the other part of the signal being applied directly to the gate 21. The combination of the multivibrators 18, 19 and 20 with the direct path between the multivibrator 16 and the gate 21 constitute a low band-pass filter which will pass the frequency at which the radiation is modulated. The output of the AND gate 21 is applied to an explosive switch or arming squib 22, which when fired initiates the arming or fuzing sequence.

Figure 2:
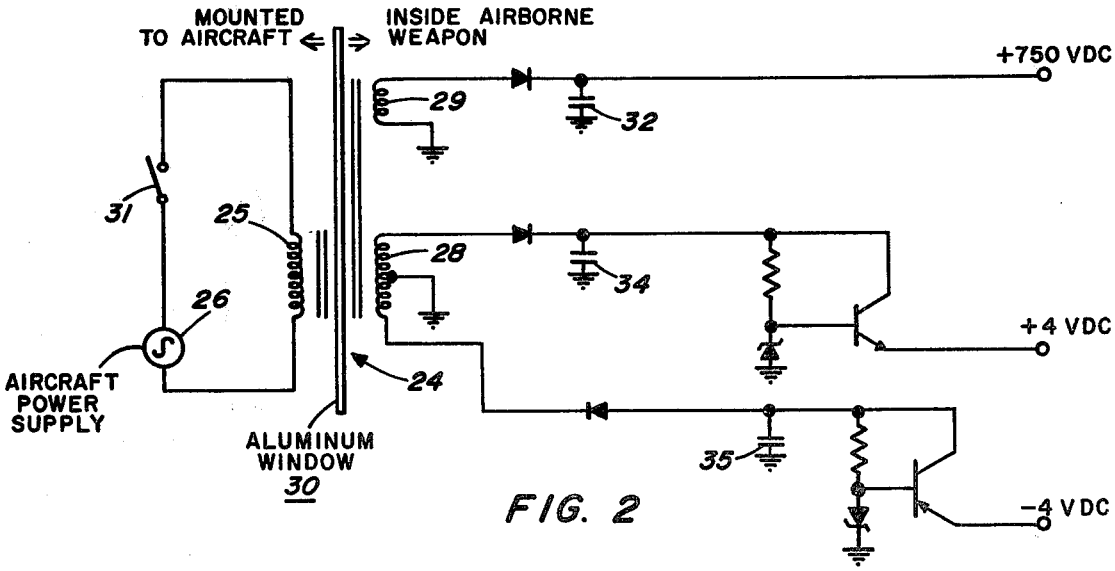
FIG. 2 is a circuit diagram of the power supply for the system of FIG. 1.

Attention now is directed to FIG. 2 wherein is disclosed the power supply for the system of FIG. 1. The power supply comprises a split-core transformer, designated generally by the reference numeral 24, having a primary winding 25 connected to the aircraft power supply 26 and having secondary windings 28 and 29 mounted inside of the airborne weapon. The weapon is provided with an aluminum window 30 of such thickness that energy may be transferred from the primary winding 25 to the secondary windings 28 and 29. The circuit containing the primary winding 25 also contains a switch 31 which is operable in conjunction with the weapon release mechanism (not shown) aboard the aircraft.

The secondary winding 29 forms part of a high voltage circuit which also includes a capacitor 32 for energy storage. After being charged, the capacitor 32 provides the high DC voltage necessary to operate the dectector 10 and the explosive switch or arming squib 22 (FIG. 1). The secondary winding 28 forms a part of a low voltage circuit which also includes capacitors 34 and 35 for energy storage. After being charged, the capacitors 34 and 35 provide the low positive and negative DC voltages necessary to operate the other elements of the system of FIG. 1.

OPERATION

In order that a better understanding of the invention may be had, its mode of operation will now be described. When the pilot of the plane carrying the weapon actuates the release mechanism, the switch 31 is closed energizing the primary winding 25 of the transformer 24. The release mechanism is so designed that the weapon is not actually free to fall until a nominal time period, on the order of twenty milliseconds, after the switch 31 has closed in order to allow the capacitors 32, 34 and 35 to become fully charged. Simultaneously with the release of the weapon, the sources of gamma radiation are exposed in the manner fully described in the aforementioned copending application. The gamma radiation from the sources is mechanically modulated at a low frequency; e.g. 15 to 25 cps. The modulation may be accomplished in any of various ways; for example, by means of a motor driven rotating drum or disc (not shown) having an interrupted surface which alternately attenuates the radiation to produce discrete groups of pulses at the desired frequency.

Figure 3:
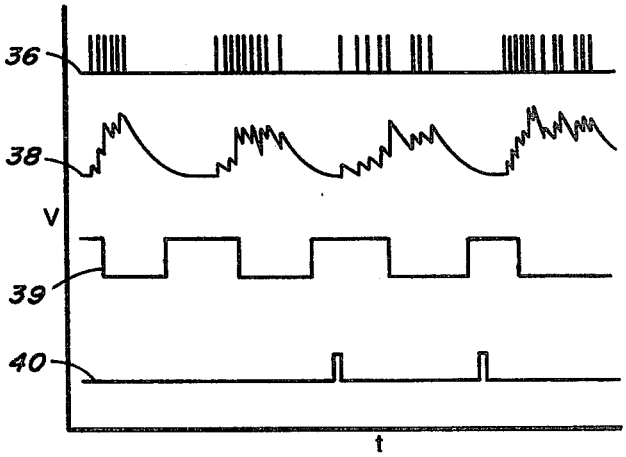
FIG. 3 represents oscilloscope traces obtained during operation of the system of FIG. 1.

Assuming a normal drop, the weapon will enter the volume of space being irradiated and the detector 10 will begin to detect radiation from the gamma radiation sources on board the aircraft. The radiation will cause the detector to emit pulses which are shaped by the shaper 11 and converted to square pulses by the multivibrator 12 before being applied to the integrator 14. Trace 36 (FIG. 3) represents discrete groups of pulses from the multivibrator 12 resulting from detection of modulated gamma radiation sensed by the detector 10. The integration of these pulses is represented by trace 38. The integrated signal is applied to the comparor 15 until the comparor threshold is exceeded at which time the comparor emits a pulse as shown by trace 39. At about this time the radiation sources on the aircraft are occluded by the mechanical modulator as can be seen by the drop in voltage of trace 38.

The pulse emitted by the comparor 15 is applied to the multivibrator 16; which applies pulses simultaneously to multivibrator 18 and AND gate 21 after timing out. Due to the time delay inherent in the train of multivibrators 18, 29 and 20, these pulses will not reach the AND gate at the same time. The multivibrators 18, 19 and 20 are designed so that the time delay will be approximately equal to one cycle of the frequency at which the radiation is modulated. The pulse widths are such that minor variations in modulation frequency may be accomodated.

While the first pulse is proceeding through the train of multivibrators 18, 19 and 20, the radiation sources aboard the aircraft are again exposed and radiation is again detected as clearly shown on traces 36 and 38. The signal will proceed as described above through the multivibrator 16. As the second pulse is applied directly to the AND gate 21 by the multivibrator 16, the first pulse will have been processed through the train of multivibrators 18, 19 and 20 and will be applied by the multivibrator 20 to the other input of the AND gate 21. The simultaneous arrival of these two pulses and the AND gate 21 will cause it to fire as illustrated in trace 40 of FIG. 3. Firing of the AND gate 21 will apply a pulse to the explosive switch 22 causing it to fire in turn and initiate the arming or fuzing sequence of the weapon.

From the foregoing, it is believed to be clear that the present invention possesses numerous advantages not found in piror art devices. The weapon is precluded from accidental arming by stray electromagnetic radiation because the energy level of such radiation is far below that necessary to operate the device. Furthermore, the device may be successfully used in areas where high levels of ambient nucleonic radiation are anticipated by setting the lower threshold of the comparor above these levels. The device will then function as described above, being responsive only to gamma radiation which is modulated at the design frequency.

It is to be understood that the aforedescribed arrangement of circuit elements is simply illustrative of a preferred embodiment of the invention. Manifestly, numerous other configurations may be readily devised by those skilled in the art to achieve a similar system still embodying the principles of the present invention and falling within the spirit and scope thereof.

What is claimed is:

1. A system for arming an airborne weapon in time delayed relation with respect to the release of the weapon from an aircraft in flight, the aircraft being provided with a mechanically modulated source of gamma radiation for irradiating a predetermined volume of space below the aircraft, comprising:

means for detecting gamma radiation;

means for comparing the magnitude of the detected radiation with a predetermined value and for generating a pulse each time the radiation exceeds that value;

a low pass filter for receiving the pulses generated by said comparing means; and means operable to initiate the arming sequence for said weapon when the frequency of the filter output equals the frequency at which the radiation source is modulated.

2. A system according to claim 1 wherein said detecting means includes:

a Geiger-Mueller tube;

means for shaping the pulses emitted by said Geiger-Mueller tube; and means for integrating said pulses to provide an input for said comparing means.

3. A system according to claim 1 wherein said comparing means comprises:

a dual level comparor;

the lower level of said comparor being set above the anticipated background radiation when said source of gamma radiation is occluded by the mechanical modulator and the higher level of said comparor being set at the radiation level anticipated when said source of gamma radiation is exposed.

4. A system according to claim 1 wherein said initiating means comprises:

an AND gate; and an explosive switch operated by an output pulse from said AND gate.

5. A system according to claim 4 wherein said low pass filter comprises:

a first monostable multivibrator;

a plurality of series connected monostable multivibrators connecting the output of said first multivibrator to one input of said AND gate; and a direct connection between the output of said first multivibrator and the other input of said AND gate.

6. A system for arming an airborne weapon in time delayed relation with respect to the release of the weapon from an aircraft in flight, the aircraft being provided with a mechanically modulated source of gamma radiation for irradiating a predetermined volume of space below the aircraft, comprising:

a Geiger-Mueller tube for detecting gamma radiation and generating pulses representative thereof;

means for shaping the pulses generated by said Geiger-Mueller tube;

means for integrating the pulses emitted by said shaping means;

means for comparing the magnitude of the integrated signal with a predetermined value and for generating a pulse each time the integrated signal exceeds that value;

a first monostable multivibrator for receiving pulses from said comparing means;

an AND gate;

a direct connection between the output of said first multivibrator and one input of said AND gate;

a plurality of series connected monostable multivibrators connecting the output of said first multivibrator and the other input of said AND gate;

said direct connection and said series connected multivibrators comprising a low pass filter whereby simultaneous pulses will be applied to said AND gate only when the gamma radiation being detected by said Geiger-Mueller tube is modulated at the frequency of operation of the mechanical modulator; and an explosive switch operable by an output pulse from said AND gate for initiating the arming sequence for said weapon.

* * * * *